US005959643A

United States Patent [19]

Temple et al.

[11] Patent Number: 5,959,643

[45] **Date of Patent: *Sep. 28, 1999**

[54] MODULAR DROP-ON-DEMAND PRINTING APPARATUS METHOD OF MANUFACTURE THEREOF, AND METHOD OF DROP-ON-DEMAND PRINTING

[75] Inventors: Stephen Temple; Mark Richard Shepherd, both of Cambridge, United Kingdom

[73] Assignee: Xaar Technology Limited, Cambridge, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/480,541

[22] Filed: Jun. 7, 1995

Related U.S. Application Data

[63] Continuation of application No. 07/945,637, filed as application No. PCT/GB91/00720, May 7, 1991, abandoned.

[30] Foreign Application Priority Data

May 8, 1990 [GB] United Kingdom ..... 9010289

[51] Int. Cl.[6] ..... B41S 2/15

[52] U.S. Cl. ..... 347/40; 347/69; 29/23.35

[58] Field of Search ..... 347/20, 42, 47, 347/54, 68, 69, 719; 29/890.1, 890.142

[56] References Cited

U.S. PATENT DOCUMENTS

| | | | |
|---|---|---|---|
| 4,184,169 | 1/1980 | Taylor et al. | 347/89 |
| 4,490,728 | 12/1984 | Vaught et al. | 347/60 |
| 4,578,687 | 3/1986 | Cloutier et al. | 346/140 R |
| 4,596,994 | 6/1986 | Matsuda et al. | 347/64 |
| 4,612,554 | 9/1986 | Poleshuk | 347/42 X |
| 4,733,823 | 3/1988 | Waggener et al. | 346/75 X |
| 4,835,554 | 5/1989 | Hoisington et al. | 347/94 |
| 4,851,371 | 7/1989 | Fisher et al. . | |
| 4,940,996 | 7/1990 | Paton et al. | 346/140 R |
| 5,016,028 | 5/1991 | Temple | 346/140 R |
| 5,189,438 | 2/1993 | Hine et al. | 347/89 |

FOREIGN PATENT DOCUMENTS

| | | | |
|---|---|---|---|
| 309146 | 3/1989 | European Pat. Off. | B41J 2/16 |
| 322228 | 6/1989 | European Pat. Off. | B41J 2/16 |
| 367541 | 5/1990 | European Pat. Off. | B41J 2/16 |
| 2 052 393 | 1/1991 | United Kingdom . | |

OTHER PUBLICATIONS

IBM Technical Disclosure Bulletin, vol. 22, No. 6, Nov. 1979, New York US, p. 2470, Crooks W. & Platakis N.S.; "Eutectic Welding of Short Nozzle Arrays to Make Up Long Arrays".

*Primary Examiner*—Benjamin R. Fuller
*Assistant Examiner*—Ci Dickens
*Attorney, Agent, or Firm*—Marshall, O'Toole, Gerstein, Murray & Borun

[57] ABSTRACT

The invention describes a method of forming a drop-on-demand printing apparatus having a body formed with a high density array of parallel channels (13) extending normal to the array direction, nozzles (27) connected respectively with the channels, printing liquid supply means with which said channels each communicate and pressure pulse applying means provided with each channel to apply pressure pulses to the channel liquid to effect droplet ejection, in which the body is formed by a plurality of like modules (2) serially butted together at facing end surfaces (49, 51) which are normal to the array direction, the arrangement enabling ejection of droplets from the channels so that said droplets are deposited on a printing surface at a predetermined spacing transversely to the direction of relative movement between the apparatus and said surface.

62 Claims, 5 Drawing Sheets

MODULAR DROP-ON-DEMAND PRINTING APPARATUS METHOD OF MANUFACTURE THEREOF, AND METHOD OF DROP-ON-DEMAND PRINTING

This is a continuation of U.S. application Ser. No. 07/945,637 filed Jan. 8, 1993, now abandoned Ser. No. 07/945,637 is a 371 of PCT/GB91/00720, filed May 7, 1991.

Improvement of printing resolution in drop-on-demand array printheads implies the provision of arrays of increasing density and therefore thinner channel walls. Where shear mode actuated arrays formed from piezo-electric material such as are described in co-pending European patent applications 88300144.8 (Publication No. 0277703) and 88300146.3 (Publication No. 0278590), are employed, the manufacturing processes for making the channels, for the formation on the channel side walls of electrodes, for passivation coating of the electrodes, for the electrical connection of the array etc., predicate manufacturing composite yields which diminish as the size of the array increases. It is accordingly one object of this invention to enable reliable manufacture of drop-on-demand printheads having high density arrays of substantial dimensions in the array direction.

The present invention consists in the method of manufacture of a drop-on-demand droplet printing apparatus of the kind comprising a body formed with a high density array of parallel printing liquid channels extending normal to the array direction, nozzles respectively connected with said channels, printing liquid supply means with which said channels each communicate and pressure pulse applying means provided with each channel and adapted to apply pressure pulses to printing liquid in the associated channel to effect droplet ejection therefrom, characterised by forming said body from a plurality of like modules serially butted together at facing end surfaces disposed normal to said array direction, and providing nozzles respectively connected with said channels, the arrangement enabling ejection of droplets from the channels so that said droplets are deposited on a printing surface at a predetermined spacing transversely to the direction of relative movement between the apparatus and said surface.

The manufacture of the array in small modules results in higher manufacturing success rate.

Advantageously, a single nozzle plate is applied to span said modules and said nozzles are formed in said plate.

Suitably, the method of the invention is characterised by forming said nozzles by providing masking means comprising two matching masks of which a first mask is a nozzle forming mask and a second mask is a module alignment mask, said nozzle forming mask being formed with an array of holes corresponding to the locations of nozzles to be formed and with module alignment marks and said module alignment mask being formed with module alignment marks matching the module alignment marks of the nozzle forming mask, employing said module alignment mask to position said modules in serially butting end to end relationship at locations predetermined by the alignment marks of said module alignment mask, assembling said modules together to form said body, bonding said nozzle plate to said body, employing said nozzle forming mask to align said modules of said body to the module alignment marks on said nozzle forming mask in the same relationship as said modules were aligned to the module alignment marks of the module alignment mask and employing said nozzle forming mask with said modules so aligned therewith to form nozzles respectively opening into the channels of said modules.

Preferably, the method includes forming said masking means from a piece of sheet material having a first part constituting said module alignment mask bearing module alignment marks and a second part constituting said nozzle forming mask bearing said array of holes and said module alignment marks matching the module alignment marks on said first part and dividing said sheet into said first and second parts to form said two matching masks In one form the method of the invention is characterised by forming said nozzles with the axes at least of alternate nozzles coplanar and so inclined so that in operation of the apparatus droplets are deposited from the nozzles on a printing surface at a substantially uniform spacing transversely in the direction of relative movement between the apparatus and said surface.

In another form the method includes forming said modules each with a sheet of piezo-electric material poled in a direction normal thereto, said channels defining channel dividing side walls therebetween, applying electrode means to channel facing surfaces of said side walls and connecting to said electrode means of each channel side wall electrical pulse applying means for effecting deflection in shear mode of said channel side walls to enable droplet ejection from said channels, characterised by forming each module in opposite end surfaces thereof with respective channel parts so that, upon butting together of said modules to form said body, further channels are formed between respective pairs of butted modules thereby to provide in said sheet an array of like channels uniformly spaced in said array direction and forming said nozzles communicating respectively with the channels of the body.

The invention further consists in a drop-on-demand droplet printing apparatus comprising a body formed with a high density array of parallel printing liquid channels extending normal to the array direction, nozzles respectively connected with said channels and pressure pulse applying means provided with each channel and adapted to apply pressure pulses to printing liquid in the associated channel to effect droplet ejection therefrom, characterised in that said body comprises a plurality of like modules serially butted together at facing end surfaces thereof disposed normal to said array direction and said nozzles are disposed to enable ejection of droplets to be deposited on a printing surface at a predetermined spacing transversely to the direction of relative movement between the apparatus and said surface.

Suitably, said nozzles are formed in a single nozzle plate which spans the channels of the serially butted modules.

In one form of the invention, in the body of the apparatus each module in said facing end surfaces is formed with respective channel parts so that further channels are formed between respective pairs of said butted modules thereby affording in said body an array of like channels uniformly spaced in said array direction and said nozzles have their axes parallel and communicating respectively with the channels of said body.

The invention further consists in masking means for forming nozzles in communication respectively with channels of a high density array of channels in an elongate body formed by a plurality of modules butted together in series, comprising a module alignment mask and a nozzle forming mask in each of which are provided matching module alignment marks and, in the nozzle forming mask, an array of holes corresponding to the location of the nozzles to be formed, whereby said module alignment mask is employed to position the modules of the body in accordance with the module alignment marks and said nozzle forming mask is employed to locate said body relatively to the module alignment marks of said nozzle forming mask in the same relationship as said modules were aligned to said alignment marks of said module alignment mask so that said holes in said nozzle forming mask can be used to form said nozzles.

Preferably, said module alignment mask and said nozzle forming mask are made from a single sheet which is severed into said masks after forming said matching alignment and said array of holes thereon.

The invention also consists in the method of manufacturing a plurality of like modules each having formed therein a high density array of parallel channels, characterised by providing a sheet of material, cutting in a surface of said sheet at least two like arrays of parallel channels on opposite sides of a part of said sheet or width in the array direction greater than the channel width and removing said part of said sheet between said arrays to separate said modules.

Suitably, there is formed at each side of said part of said sheet between said arrays and adjoining said part a further channel parallel with and of depth greater than the array channels and of half the width of the array channels in the array direction and separating said modules by removing from the side of a sheet remote from the arrays a portion of width in the array direction greater than the part of the sheet between the arrays and which intersects each of the further channels.

The invention will now be described, by way of example, with reference to the accompanying drawings, in which:

FIGS. 1(*a*), 1(*b*), 1(*c*) and 1(*d*) are respective sectional side elevations of array, drop-on-demand printheads formed by the manufacturing methods of the present invention;

FIG. 2(*b*) is a fragmentary perspective view of a printhead module at a stage of manufacture following that illustrated in FIG. 2(*a*);

Figure 1A:
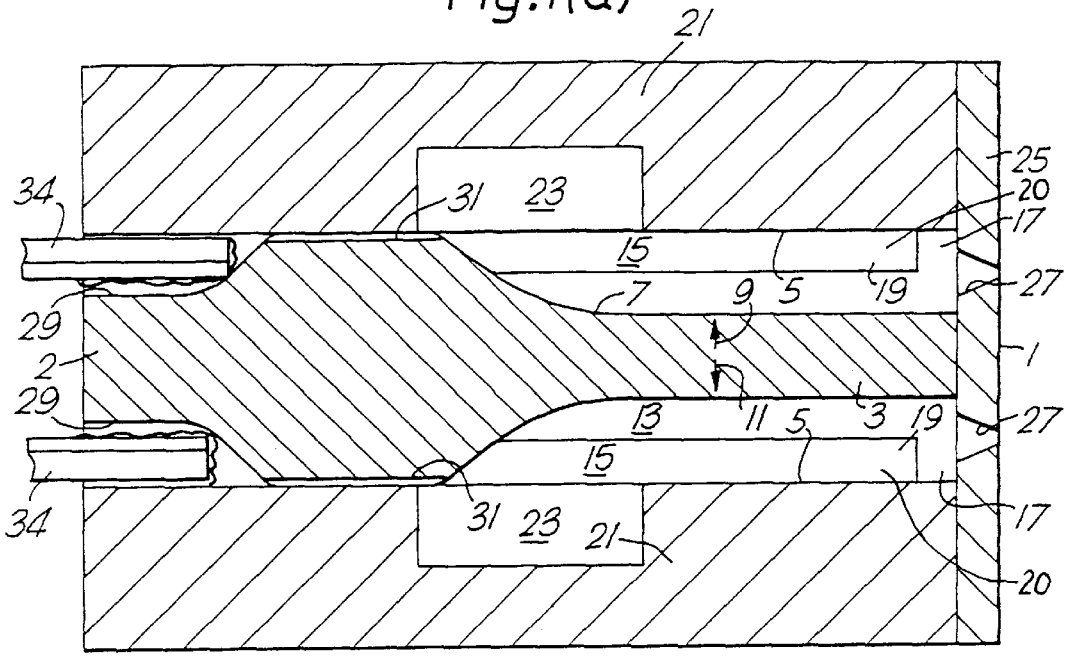
Figure 1C:
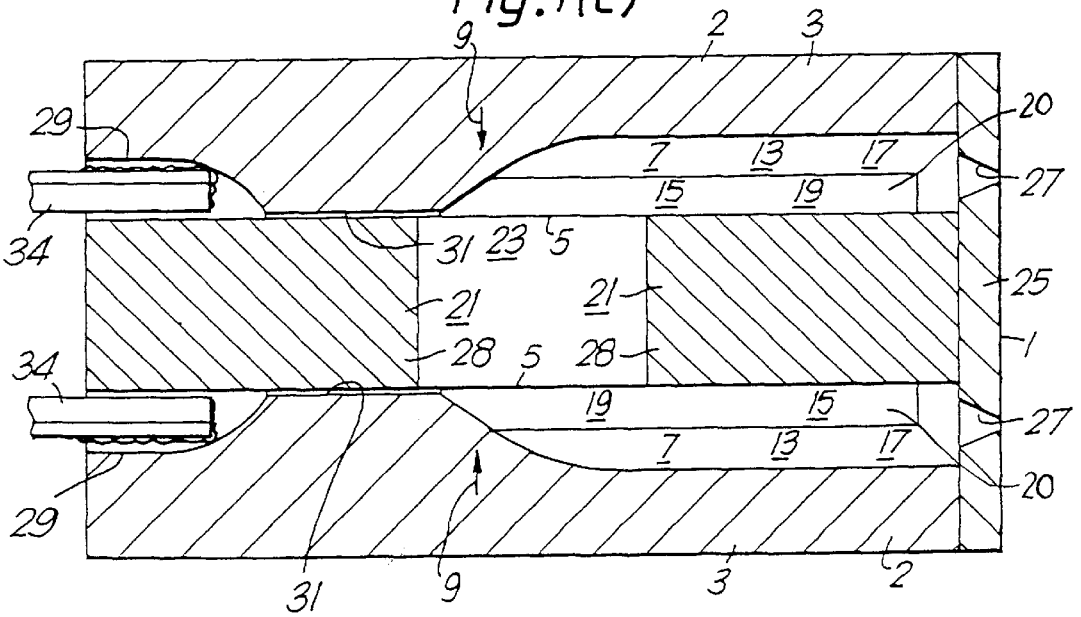
Figure 1B:
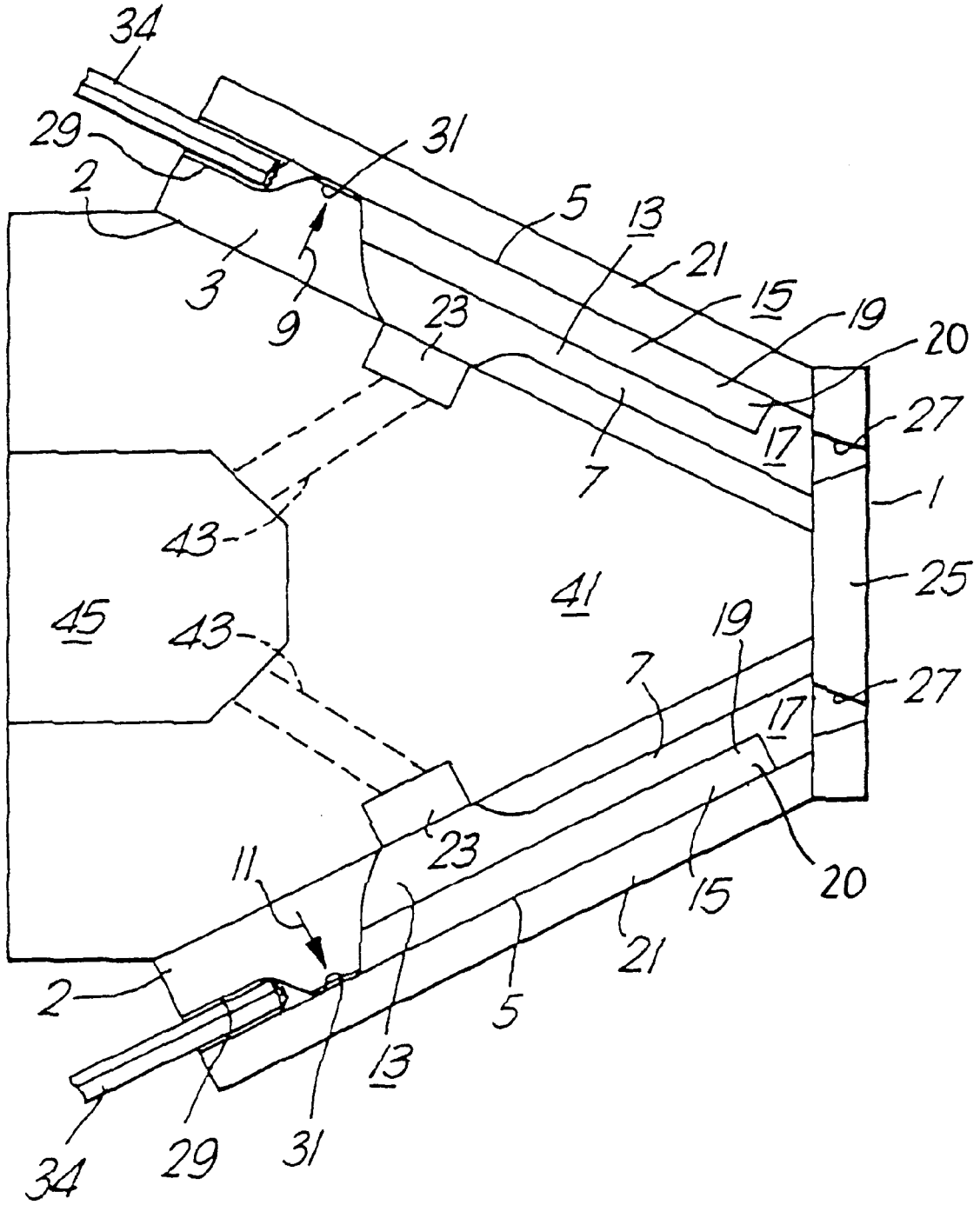
Figure 1D:
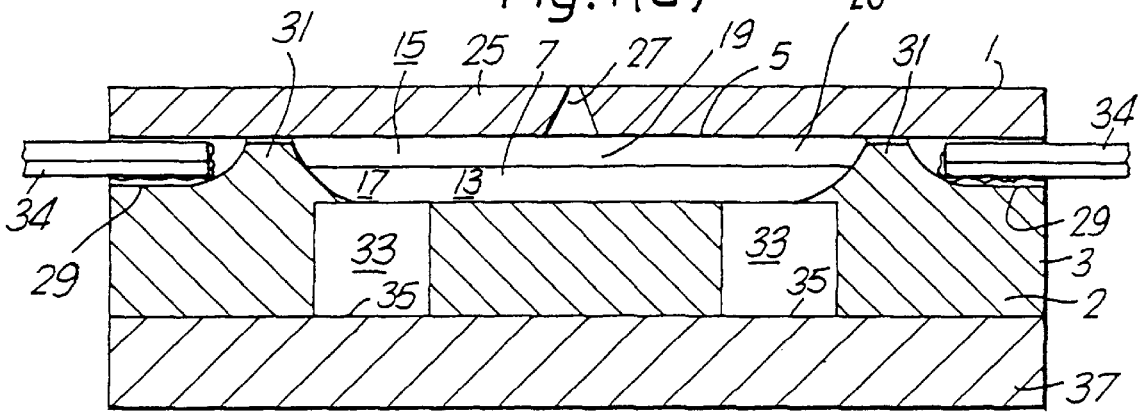

The description which follows relates to the manufacture of array, drop-on-demand printheads which comprise a sheet of piezo-electric material poled in a direction normal to the sheet and formed with an array of printing ink channels which extend normal to the array direction and define channel dividing side walls therebetween, nozzles respectively connected with said channels, printing ink supply means with which said channels each communicate, electrode means applied to channel facing surfaces of said side walls and means for connecting said electrode means to electrical pulse applying means to effect deflection in shear mode of said channel side walls to cause droplet ejection from said channels, said deflection of each side wall being in the direction of the field applied thereto when the electrode means thereof are subject to an electrical pulse from said pulse applying means.

Such printheads are described in European Patent Publications Nos. 277,703; 278,590; and 364,136, the respective contents of which are incorporated herein by reference.

Notwithstanding that the following description of the embodiments of the invention is based on array printheads of the kind referred to, it will be-apparent to those skilled in the art that the invention described herein is also applicable to other forms of array printhead such as are illustrated, for example in U.S. Pat. No. 4,584,490 and U.S. Pat. No. 4,296,421.

Referring now to FIGS. 1(*a*) to 1(*d*), in which like parts are accorded the same reference numerals, the array printhead 1 illustrated in FIG. 1(*a*) comprises a sheet 3 of piezo-electric material, suitably PZT (lead zirconium titanate), formed in opposite faces 5 thereof with array channels 7 and poled normal to said channels as indicated by arrows 9 and 11. As will be appreciated from the description below of FIGS. 2 to 4, the array printheads of FIGS. 1(*a*)–1(*d*) are formed from serially butted modules 2 of limited length in the array direction, that is to say the direction perpendicular to and in the plane of the axes of channels 7. Many considerations influence the choice of module length to be employed, for example processing and assembly yields of the module sub-assembly, thermal expansion tolerances in the array direction, available PZT material sizes, available LSI drive chip number of terminations, etc.

The channels 7 are cut in the sheet 3 by grinding using a dicing cutter of the kind described in European Patent Publication No. 309,148 and in the manner described in European Patent Publication No. 364,136 so that the channels are defined between facing side walls 13 having channel facing surfaces 17 on opposite sides thereof to which are applied respective coatings 15 of metal to provide electrodes 19 to which an electrical impulse can be applied to cause deflection of the corresponding side wall in the direction of the field caused by the impulse. Such deflection in turn causes a pressure pulse to be applied to printing liquid in the channel. In operation of the arrangement of FIG. 1(*a*) any particular channel is activated by applying a pulse to the electrodes 19 of each of the channel side walls and each side wall is employed in the pulsing of the channels on opposite sides thereof.

The electrodes 19 have a passivation layer 20 applied thereto which insulates them electrically and protects them from chemical attack.

The channels 7 are provided with cover plates 21 in which are formed printing ink supply ducts 23 which extend in the array direction and communicate with each channel 7. At the forward ends thereof the channels 7 are closed by a nozzle plate 25 which spans all the serially butted modules 2 and in which are formed convergent nozzles 27 which communicate with the respective channels 7 of the modules. At the ends of the channels 7 remote from the nozzle plate are provided respective connection recesses 29 which are in alignment with the channels so that each connection recess connects with the corresponding channel by way of a bridge 31. The channels 7 are cut by the dicing cutter referred to, to a greater depth than the depth of the connection recesses which are cut to a greater depth than the bridges. With this arrangement, by plating the electrodes 19 to a depth in the channels greater than the depth of the connection recesses, the bridges and sides and base of the connection recesses are coated with metal to render them conducting in the respective stages that the facing surfaces of the channel side walls have the electrodes 19 applied thereto.

The connection recesses 29 are connected by bonding to terminations 34 of an LSI multiplexer silicon chip.

The rows of nozzles 27 are mutually staggered so that drops deposited therefrom on the printing substrate are at double the density of each of said rows. These nozzle rows are formed in the manner described in European Patent Publication No. 309,146.

Whilst the arrangement of FIG. 1(*a*) has been described as having channel arrays in opposite faces of the sheet 3, the channel arrays could instead be formed in separate sheets which, subsequently, are disposed back to back.

Referring now to FIG. 1(*b*) in which is shown an alternative printhead layout. This provides a tapered block member 41 on which the sheets 3 formed with the respective channel arrays are mounted. The member 41 instead of the cover plates 21 houses the ink feed ducts 23 which are supplied through passages 43 from an ink supply manifold 45. As in the embodiment of FIG. 1(*a*) two rows of mutually staggered nozzles 27 are provided for the channels 7 of the respective arrays.

The design of the printhead of FIG. 1(*c*) is derived from that of FIG. 1(*a*) by taking sheet 3 where this is formed as two sheets disposed back to back and arranging those sheets with the channel arrays thereof facing one another. The cover plate 21 is in two parts 28 disposed in parallel between the sheets 3 and to which the sheets 3 are bonded so that the parts 28 define therebetween the printing ink supply duct 23. Again, the nozzle plate 25 spans the serially butted modules 2 of each array and is formed with two rows of mutually staggered nozzles 27 which communicate with respective channels 7.

The printhead illustrated in FIG. 1(*d*) comprises a single row of nozzles 27 in the nozzle plate 25 which communicate with the respective ink channels 7 of the sheet 3 of serially butted modules 2 at the mid-point of the length of the channels. The channels 7 are provided at each end thereof with a connection recess 29 which connects with the channel, as in the arrangements already described, by way of a bridge 31. The ink feed to the channels 7 is provided by two ducts 33 cut in a cover face 35 of the sheet 3 to a depth such that they communicate with opposite ends respectively of the channels 7 and a cover plate 37 is bonded to the face 35 of the modules 2 to close the ducts 33. Accordingly, ink is delivered to each channel 7 upon actuation thereof from opposite directions and the arrangement in operation provides condensation flow from both ends of the channel and permits operation at a lower voltage.

The manner of serially butting together the modules 2 of the printhead is now described using the printhead section of FIG. 1(*c*) for illustrative purposes. The procedure described involves the production and assembly of modules which have active channels formed on only one face of a sheet 3 of piezo-electric material. The principles of manufacture and assembly of these butted modules can be applied to other printhead structures, for example, those disclosed in U.S. Pat. No. 4,584,490 and U.S. Pat. No. 4,296,421.

Figure 2A:
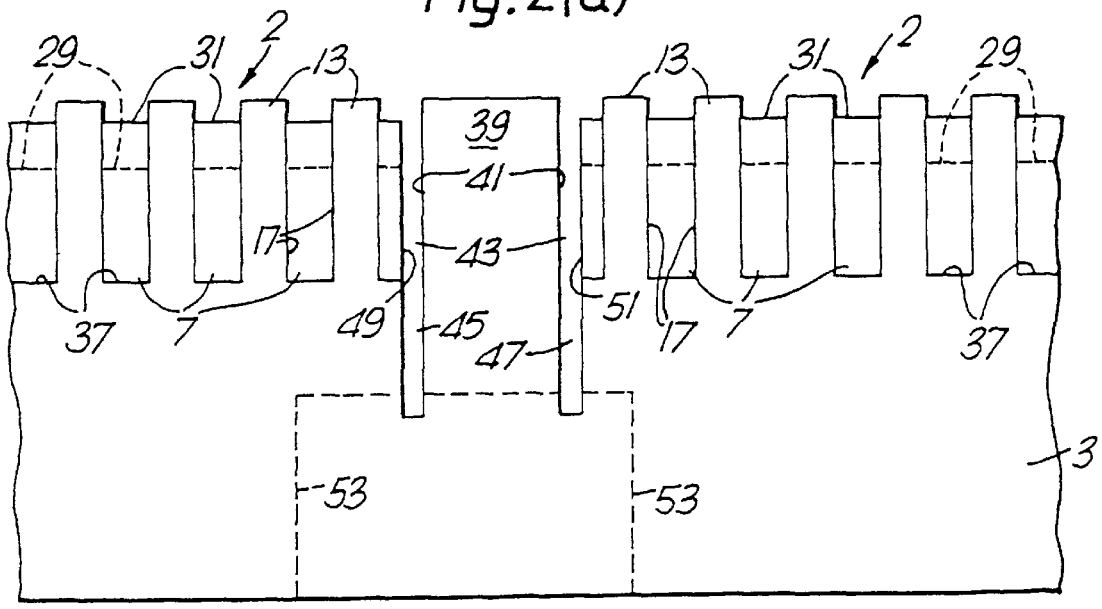
FIG. 2(*a*) is a sectional end elevation of a piezo-electric sheet of material illustrating a stage in the manufacture according to the invention of the printhead illustrated in FIG. 1(*c*)
Figure 2B:
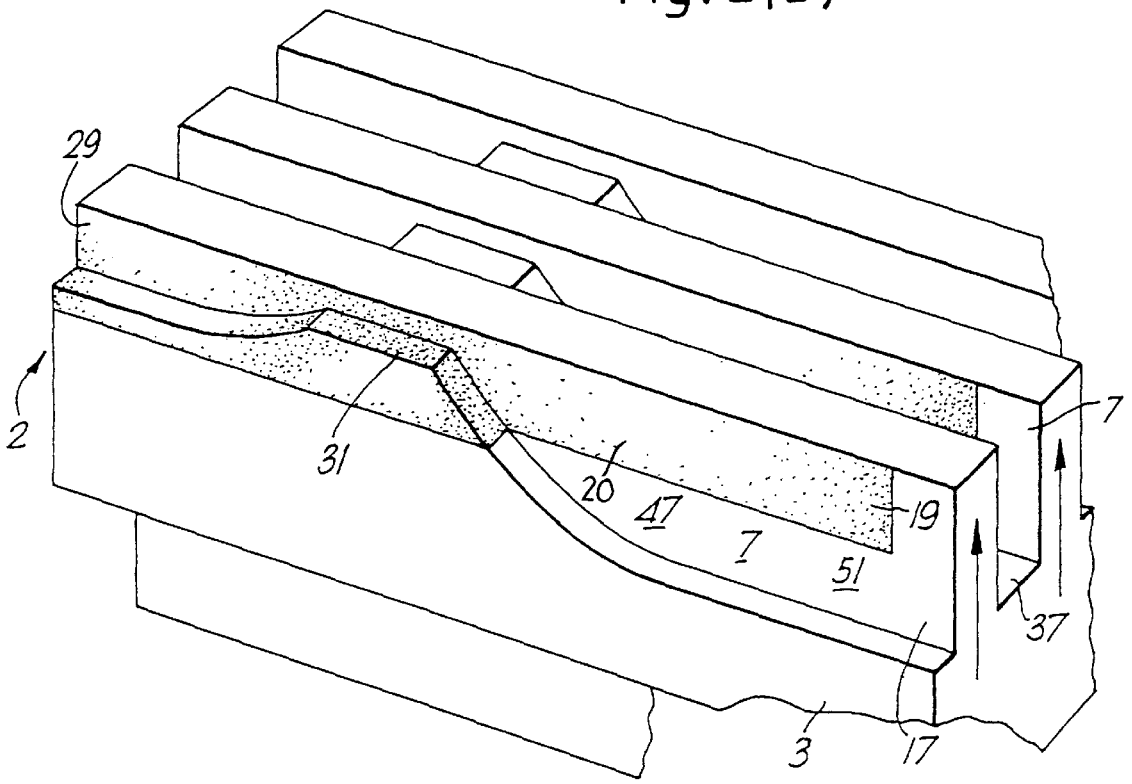

FIG. 2(*a*) illustrates a sheet 3 of piezo-electric material formed with two arrays of channels 7 of respective modules 2 and the channels of each array being formed by side walls 13 having facing surfaces 17 and bottom surfaces 37. The channels are provided at corresponding ends thereof with respective connection recesses 29, there being a bridge 31 between each channel and its connection recess which on bonding of the cover plate 21 forms a liquid seal.

The modules 2 are connected by a thick wall 39 which is, as hereinafter described, later removed thus separating the modules. Outer surfaces 41 of the wall 39 are defined by cuts 43 formed by a narrow dicing blade which forms half-width channels 45 and 47. These are cut deeper than the channels 7 and have a uniform depth. The narrow dicing blade in cutting the half width channels, dresses the outer surfaces 49 and 51 of channels 45 and 47 and the outer surfaces 41 of the thick wall 39, the latter surfaces being located to enable plating down the wall of the outermost channel of each module to the same extent as is desired for the surfaces 17 of channel walls 13. A similar wall 39 and a half width channel is located at the outer end of each module so that each module has like ends.

After plating of the surfaces 17 of the channels to form the electrodes 19 and the half channels in the manner described in European Patent Publication No. 364,136 and application to the deposited electrodes 19 of a passivation layer, the sheet 3 in which the modules 2 are formed is transferred robotically to a second jig where it is mounted in inverted position in which cuts 53 are formed which extend into the sheet 3 beyond the bottom of the half-channels 45 and 47. The body of the sheet material between the cuts 53 is removed by the action of making the cuts 53 at low tolerance so that the modules 2 are separated. FIG. 2(*b*) illustrates in perspective one of the modules 2 after separation thereof.

In the arrangement of FIG. 1(*d*) the ink supply ducts 33 are formed in the sheet 3 and the electrode plating is conveniently done following the cutting of the channels 7 or at any time prior to separating the nodules.

After the modules are separated they are robotically transferred to an assembly jig where they are optically aligned end to end.

When assembling a printhead from modular components, tolerancing is of great importance. In particular, it is desirable to locate the nozzle centres (and drop ejection axes) to an optical standard of accuracy in order to achieve uniform and repeatable drop placement accuracy which is especially important for 4-colour printheads to avoid Moire interactions.

It is therefore necessary, first to manufacture the modules with their array channels 7 at a pitch accuracy within defined tolerances in each module. Secondly, the modules have to be assembled into locations so that the channels from one module to the next fall within acceptable tolerances, and, thirdly when the nozzle mask through which, in the manner described in European Patent Publication No. 309,146, the nozzles are ablated in the nozzle plate 27 which is applied to the full width of the printhead, the nozzles across the entire printhead must respectively fall wholly or substantially within the channels.

The multi-disc cutter and the cutter for making the half-width channels are able to achieve the manufacturing channel tolerances in the modules in the sheet 3 if necessary employing temperature control for modules up to a maximum width. The second and third steps are achieved by making the nozzle ablation mask and a module alignment mask either separately with matching module alignment marks or together from a single sheet which is divided to separate the nozzle ablation mask portion from the module alignment mask portion and ensure by reason of matching module alignment marks in the masks that a printhead which is assembled with the alignment mask has nozzles formed in its nozzle plate with the matching ablation mask which communicate respectively with the printhead channels.

Figure 3:
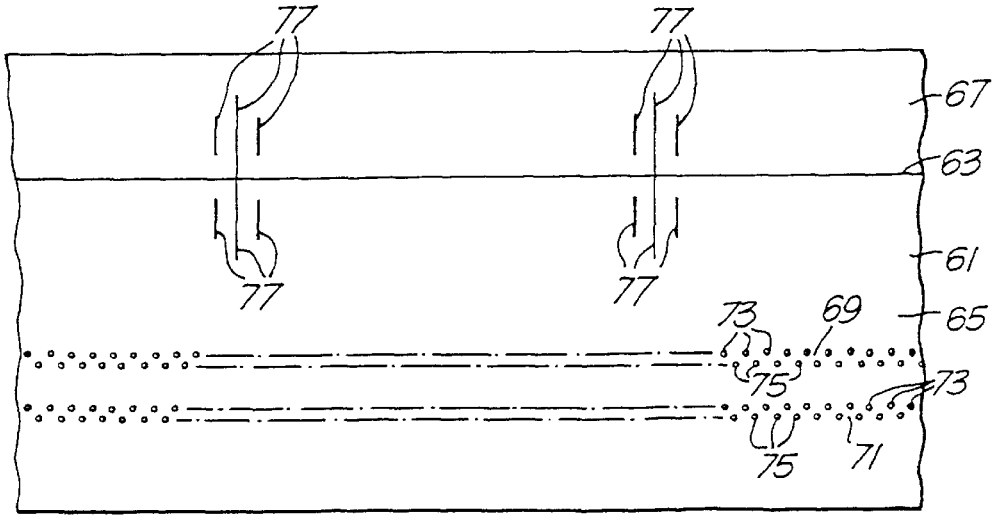
FIG. 3 is a plan view of a mask used for alignment of modules and for the nozzle manufacture stage of the printhead; and, FIG. 4(*a*) is a diagrammatic plan view illustrating the nozzle forming stage in the manufacture of the printhead.

Accordingly a mask 61, illustrated in FIG. 3, is provided which is made of silicon and from which the alignment and nozzle ablation masks are produced. Silicon is a suitable material for making a full width printhead nozzle ablation mask because it has a high ablation threshold, suitable for an excimer laser contact ablation mask, a low thermal expansion coefficient and because precision silicon etching is widely practiced.

The area of the mask 61 is accordingly divided by separation line 63 etched thereon into two parts 65 and 67. In part 65 are etched two pairs 69, 71 of rows 73 and 75 of coplanar, alternate holes. In each pair 69 and 71 the holes in the rows 73 and 75 are offset by a spacing of half the print resolution and are of a size suitable for ablating nozzles in the manner described in European Patent Publication No. 309,146. Etched in the mask 61 adjacent the nozzles holes at locations representing the centre lines of the modules are pairs of marks 77 which straddle the separation line 63 so that after separation of the mask along the line 63, each part thereof is provided with module registration marks 77. Thus the part 67 of the mask is used to align the modules during bonding thereof whilst the part 65 is used to ablate the nozzles.

To assemble the printhead, the alignment mask 61 is first placed at suitable station of a "pick and place" robot adjacent a full width cover plate 25. The alignment of the mask and cover plate is not critical and can be achieved to the requisite extent by pressing each longitudinally against an end stop. The modules are subject in the "pick and place" machine to a sequence of steps which includes:

(a) picking up each module 2 from the sheet 3 from which it has been separated;

(b) connecting an LSI chip terminations to the connection recesses of the modules, (c) testing the integrity of the electrical connections and the activity of the channel side walls, (d) applying bonding glue to the end walls of the modules and the faces thereof to be secured to the cover plate, (e) placing the modules in alignment on the printhead.

Alignment is carried out employing a vision camera which images both the module and the alignment marks on part 67 of the mask 61 in optically superimposed images. The centre of the module is ascertained by computer and the module is then moved to the cover plate so that the centre of the module as seen by the camera is in alignment with the requisite alignment mark 77 on the mask part 67. This procedure is repeated with successive modules until a module is in alignment with each mark 77 on the mask part 67. The tolerances between the modules are made up by filling with glue bond material. The glue bonds between the modules and between the modules and the cover plate are cured by an UltraViolet (UV) curing or heat curing energy pulses.

Another camera may be employed to inspect the bond lines for 100 per cent integrity thereof.

Although the method described of module alignment calls for the employment of a module alignment mask to effect correspondence between alignment marks on centres of the modules and the mask, an alternative indirect procedure can be adopted in which the alignment mask is used to create marks on a substrate, suitably an array wide sheet which serves as the cover plate of the channels. Thus the modules are assembled by alignment thereof on the substrate relatively to the marks created thereon through use of the alignment mask.

It will be noted that in the case of the embodiments of FIGS. 1(*a*) and (*c*) the common ink supply means for the channels of the assembled printhead are located in the cover plate of the channels whereas in the embodiment of FIG. 1(*d*) the common ink supply means are formed by first butting together of the modules and then mounting the butted modules on the cover plate. In FIG. 1(*b*), however, the common ink supply is provided in the mounting block on which the modules and their cover plate 21 are carried.

In the nozzle ablation process the printhead is conveyed into an ablation station where it is placed adjacent the nozzle ablation mask which was formed in the alignment mask part 65, part 67 of which was used for assembly of the modules. Alignment of the mask part 65 with the printhead is again checked with a vision camera. The silicon mask part 65, the nozzle plate 25 and PZT sheet 3 are partly transmissive to infra-red light so an image of the channels on the nozzle mask part can be obtained and nozzle placement in the channels verified. The nozzles are then progressively ablated simultaneously along the full length of the printhead. Consequently the precaution of making and assembling parts by the above jigging procedure indicates that tolerances of $\pm 3\ \mu$ in nozzle placement can be met even though the manufacturing and assembly tolerances are greater.

In the event that the channels common to two butted modules are unusable as active channels, for example, if the glue bonds prove unreliable and cannot be sealed against the actuating ink pressure, then one or more channels will be inactive.

Figure 4A:
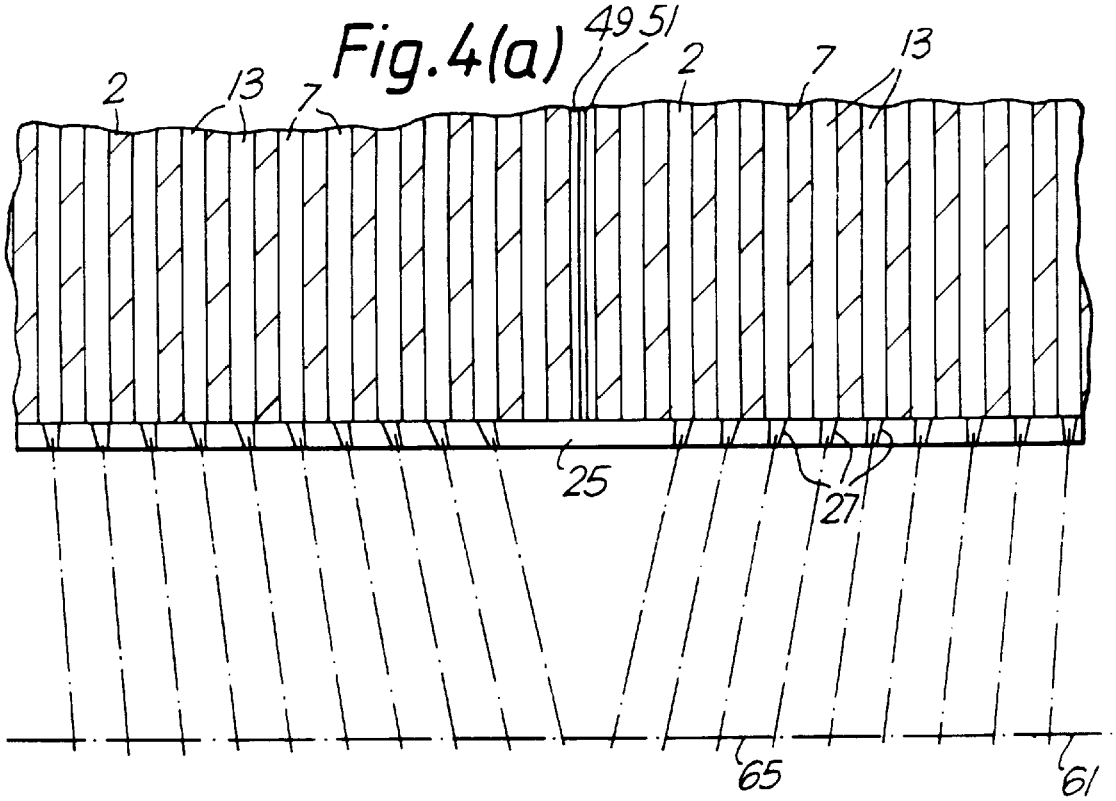
FIG. 4(*b*) is a view of the apparatus used in the nozzle manufacturing stage illustrated in FIG. 4(*a*).
Figure 4B:
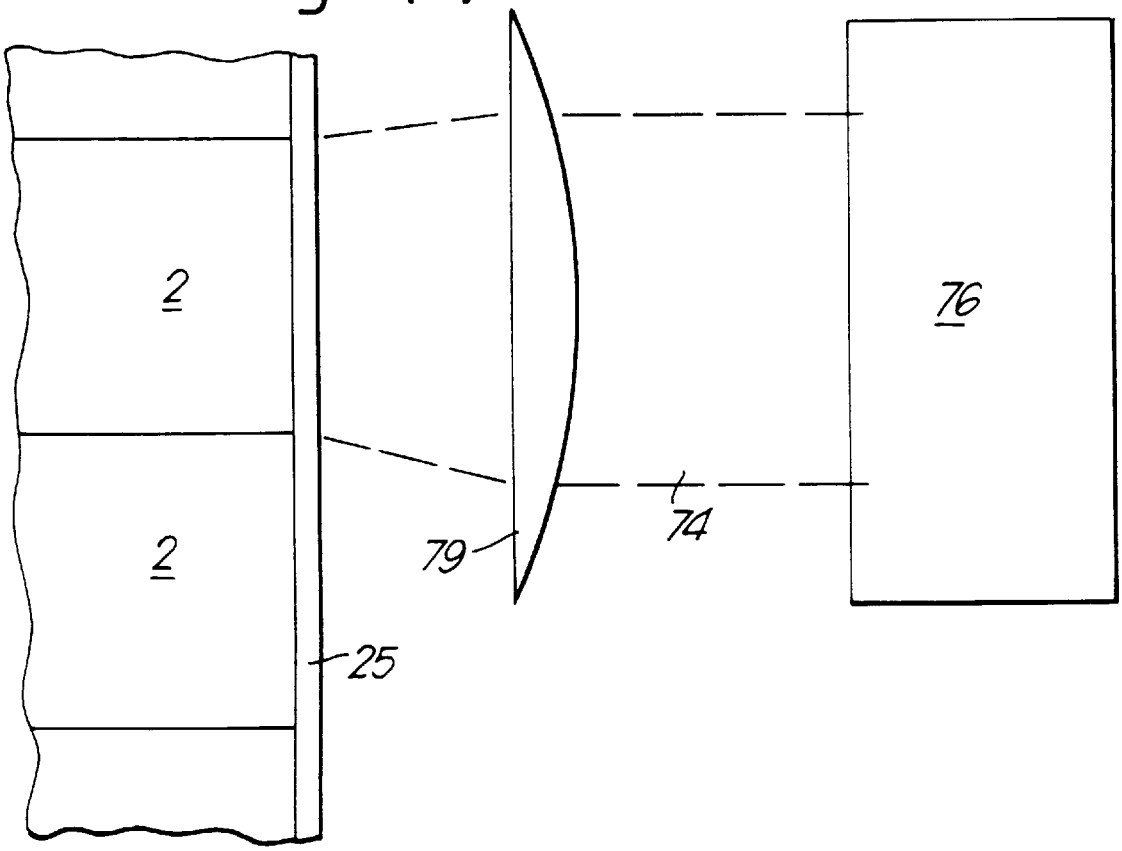

FIGS. 4(*a*) and (*b*) illustrate the nozzle ablation procedure applicable to modules separated by one or more inactive channels. In this case the ablation jig is placed adjacent to the full width nozzle plate 25 and is ablated in sections corresponding to each module width. A light beam 74 from UV excimer laser source 76, though, if desired, other forms of high energy beams can instead be used, is directed onto the nozzle plate 25 with a small degree of convergence by way of a lens 79 or mirror. As a consequence the nozzles are ablated with their axes slightly fanned. The nozzles at the end of each module therefore spread so that at a distance equal to the drop flight path from the nozzle plate to the paper surface, the printed dots are uniform, the actual density of nozzles along the nozzle plate therefore being greater than the mean dot spacing.

It will be apparent that where the channels between the butted modules are usable, the nozzles are ablated with their axes parallel employing a parallel laser beam.

In an alternative embodiment of the invention the modules are formed with each end surface thereof contained in a plane normal to the array direction and with the thickness of the outer walls of the end channels of each module substantially the same or greater than that of the other channel walls of the module. The wall thickness at the junction of each pair of modules thus exceeds that of the other channel walls of the modules. Accordingly, the nozzles 27 in the plate 25 are formed as described in relation to FIGS. 4(*a*) and 4(*b*) so that the nozzles of the modules are fanned progressive outwards from the centre of the modules.

We claim:

1. A method of manufacturing a drop-on-demand droplet printing apparatus comprising a body formed with a high density array of open topped parallel printing liquid channels extending normal to an array direction, a cover on said body to close the channels, nozzles respectively connected to said channels, means for supplying printing liquid with which said channels each communicate and means for applying pressure pulses provided with each of said channels in said body and adapted to apply said pressure pulses to the printing liquid in respective said channels to effect droplet ejection therefrom, the method comprising the step of forming said body from a plurality of like modules serially butted together at facing end surfaces disposed normal to said array direction, with each of said modules having in opposite end surfaces thereof respective channel parts so that on butting together of said modules to form said body, further channels are formed between respective parts of said butted modules, said further channels having said means for applying said pressure pulses so enabling ejection of droplets from the channels so that said droplets are deposited on the printing surface at a predetermined spacing transversely to a direction of relative movement between the apparatus and said surface.

2. The method claimed in claim 1, comprising the step of applying a single nozzle plate to said body to span said modules and forming said nozzles in said plate.

3. The method according to claim 2, comprising the steps of forming said nozzles by providing two matching masks of which a first mask is a nozzle forming mask and a second mask is a module alignment mask, said nozzle forming mask being formed with an array of holes corresponding respectively in locations to nozzles to be formed and with module alignment marks and said module alignment mask being formed with module alignment marks matching the module alignment marks of the nozzle forming mask, employing said module alignment mask to position said modules in a serially butting end to end relationship at locations predetermined by the alignment marks of said module alignment mask, assembling said modules together to form said body, bonding said nozzle plate to said body, employing said nozzle forming mask to align said modules of said body to the module alignment marks on said nozzle forming mask in said relationship of alignment of said modules to the module assignment marks of the module alignment mask and employing said nozzle forming mask with said modules so aligned therewith to form nozzles respectively opening into the channels of said modules.

4. The method claimed in claim 1, wherein the nozzles comprising the step of forming said nozzles with the axes of at least alternate nozzles coplanar and so inclined so that in operation of the apparatus droplets are deposited from the nozzles on a printing surface at a substantially uniform spacing transversely in the direction of relative movement between the apparatus and said surface.

5. The method claimed in claim 4, comprising the step of forming said nozzles with a slightly convergent, high energy beam directed towards the nozzle plate and by way of a mask formed with apertures corresponding to the nozzles to be formed.

6. The method claimed in claim 1, which includes forming said modules each with a sheet of piezo-electric material poled in a direction normal thereto, said channels defining channel dividing side walls therebetween, applying electrode means to channel facing surfaces of said side walls for the generation of electric fields in said side walls and connecting to said electrode means electrical pulse applying means for effecting deflection in shear mode of said channel dividing side walls to enable droplet ejection from said channels.

7. The method claimed in claim 1 or claim 6, comprising the step of forming said channel parts so that a junction of each pair of butted modules extends in a plane normal to said array direction and each of said further channels formed between said pair of butted modules has a longitudinal axis contained with said normal plane.

8. The method claimed in claim 7, comprising the step of applying, prior to butting of said modules, said electrode means to channel facing surfaces of said side walls of each of said modules including the side wall surfaces of said channel parts each of which faces a corresponding channel part of the other module of the respective pair of modules.

9. The method claimed in claim 8, comprising the step of applying a layer of passivation material to said electrode means.

10. The method claimed in claim 8 or claim 9, comprising the step of forming in each of said modules an array of connection recesses corresponding with and respectively connected to said channels, coating said recesses with conductive material, and electrically connecting the electrode means of the channels to said conductive material of respective connection recesses.

11. The method claimed in claim 10, comprising the step of forming in each of said modules an array of bridges respectively connecting said array channels with said corresponding connection recesses, and coating said bridges with conductive material to effect electrical connection between said electrode means of the respective channels and said conductive material of the corresponding connection recess.

12. The method claimed in claim 11, comprising the step of forming said array channels collinearly with the respective connection recesses and bridges, forming said channels of a uniform depth, forming said recesses of a uniform depth less than the depth of said channels, forming said bridges of a uniform depth less than the depth of said recesses, and applying said electrically conductive material simultaneously to form said electrode in the channels to a depth greater than the depth of the connection recesses, said conductive material on the bridges, and said conductive material in the connection recesses.

13. The method claimed in claim 1, with said channels having respective axes lying in a common plane, comprising the step of forming said body from said modules with at least a number of said nozzles of each of said modules adjacent each of said butted surfaces thereof outwardly fanned in said common plane to enable deposition of droplets from the channels corresponding to said outwardly fanned nozzles to be deposited on said printing surface at uniform spacing.

14. The method claimed in claim 2, comprising the step of forming said modules with end surfaces each contained in a plane extending normal to the array direction of said channels, butting said modules together to form said body, applying said single nozzle plate to assembled butted modules and so forming in said nozzle plate respective nozzles for channels of the array such that droplets ejected from said nozzles at a distance equal to the drop flight path thereof to a printing surface are substantially uniformly spaced in the direction transverse to that of relative motion between said apparatus and said surface.

15. The method claimed in claim 14, wherein each said module has opposite ends with a center disposed therebetween, and said nozzles are formed in said nozzle plate by laser ablation using a convergent excimer laser beam to form nozzles having axes progressively increasingly inclined from the nozzles at the center of each of said modules to the nozzles at opposite ends in the array direction of each of said modules.

16. The method claimed in claim 1, wherein each channel has a length and communicates at opposite ends of the channel with ducts for supply of printing liquid and at a midpoint of the length of the channel with a respective nozzle.

17. The method claimed in claim 16, wherein said nozzle of each of said channels is formed in said cover.

18. A method of manufacturing a drop-on-demand droplet printing apparatus comprising a body formed with a high density array of parallel printing liquid channels extending normal to an array direction, nozzles respectively connected with said channels, means for supplying printing liquid with which said channels each communicate and means for applying pressure pulses provided with each of said channels and adapted to apply said pressure pulses to the printing liquid in respective said channels to effect droplet ejection therefrom, the method comprising the steps of forming said body from a plurality of like modules serially butted together at facing end surfaces disposed normal to said array direction so as to enable ejection of droplets from the channels so that said droplets are deposited on a printing surface at a predetermined spacing transversely to a direction of relative movement between the apparatus and said surface, applying a single nozzle plate to said body to span said modules and forming said nozzles by providing two matching masks of which a first mask is a nozzle forming mask and a second mask is a module alignment mask, said nozzle forming mask being formed with an array of holes corresponding to locations of nozzles to be formed and with module alignment marks and said module alignment mask being formed with module alignment marks matching the module alignment marks of the nozzle forming mask, employing said module alignment mask to position said modules in serially butting end-to-end relationship at locations predetermined by the alignment marks of said module alignment mask, assembling said modules together to form said body, bonding said nozzle plate to said body, employing said nozzle forming mask to align said modules of said body to the module alignment marks on said nozzle forming mask and employing said marks of the module alignment mask and employing said nozzle forming mask with said modules so aligned therewith to form nozzles respectively opening into the channels of said modules, wherein said masks are formed from a piece of sheet material having a first part constituting said module alignment mask bearing module alignment marks and a second part constituting said nozzle forming mask bearing said array of holes and said module alignment marks matching the module alignment marks on said first part and dividing said sheet into said first and second parts to form said module alignment mask and said nozzle forming mask.

19. The method claimed in claim 18, comprising the step of forming said masks from material having a high ablation threshold and employing an ablation laser to form said nozzles.

20. The method as claimed in claim 19, comprising the steps of forming said masks from silicon and forming said holes therein and said alignment marks thereon by etching.

21. A drop-on-demand droplet printing apparatus comprising a body formed with a high density array of open topped parallel printing liquid channels extending normal to an array direction, a cover on said body to close the channels, nozzles respectively connected with said channels and means for applying pressure pulses provided with each of said channels in said body and adapted to apply pressure pulses to the printing liquid in an associated channel to effect droplet ejection therefrom, wherein said body comprises a plurality of like modules with each said module having end surfaces disposed normal to said array direction, said modules being serially butted together with respective end surfaces thereof facing each other, with each of said modules being formed in said facing end surfaces with respective channel parts so that further channels are formed between respective pairs of said butted modules thereby affording in said module an array of like channels uniformly spaced in said array direction, said further channels having said pressure pulse applying means and said nozzles having respective parallel axes to enable ejection of droplets to be deposited on a printing surface at a predetermined spacing transversely to a direction of relative movement between the apparatus and said surface.

22. Apparatus as claimed in claim 21, wherein said nozzles are formed in a single nozzle plate which spans the channels of the serially butted modules.

23. Apparatus as claimed in claim 21 and in which each of said modules comprises a sheet of piezo-electric material poled in a direction normal thereto, said channels formed in said sheet defining channel dividing side walls therebetween having electrode means on facing surfaces thereof for the generation of electric fields in said side walls and electrical pulse applying means are connected to said electrode means for effecting deflection in shear mode in the direction of the respective fields to enable droplet ejection from said channels.

24. Apparatus as claimed in claim 21 or claim 23, wherein a junction of each pair of butted modules extends in a plane normal to said array direction and each of said further channels formed between said pair of butted modules has a longitudinal axis contained within said normal plane.

25. Apparatus as claimed in claim 23, wherein, prior to butting of said modules, said electrode means are applied to channel facing surfaces of said side walls of each of said modules including the side wall surfaces of said channel parts facing a corresponding channel part of the other module of the respective pair of modules.

26. Apparatus as claimed in claim 25, wherein a layer of passivation material overlies said electrode means.

27. Apparatus as claimed in claim 25 or claim 26, wherein an array of connection recesses corresponding with and respectively connected to said channels is provided in each of said modules, said recesses being coated with conductive material, and being electrically connected to the electrode means of the channels.

28. Apparatus as claimed in claim 27, wherein each module is provided with an array of bridges respectively connecting said array channels with said corresponding connection recesses, said bridges being coated with conductive material to effect electrical connection between said electrode means of the respective channels and said conductive material of the corresponding connection recess.

29. Apparatus as claimed in claim 28, wherein said array channels are disposed collinearly with the respective connection recesses and bridges and said channels are of a uniform depth, said recesses are of a uniform depth less than the depth of said channels, and said bridges are of uniform depth less than the depth of said recesses.

30. Apparatus as claimed in claim 21, wherein said butted modules each have end surfaces contained in a plane extending normal to the array direction of said channels and said nozzles are so formed that droplets ejected therefrom at a distance equal to the drop flight path thereof to a printing surface are uniformly spaced in the direction transverse to that of relative movement between said apparatus and said surface.

31. Apparatus as claimed in claim 29, wherein said nozzles are disposed in a nozzle plate spanning said modules and have axes progressively increasingly inclined from the nozzles at the center of each of said modules to the nozzles at opposite ends in the array direction of said module.

32. Apparatus as claimed in claim 21, wherein ink supply duct elements communicate with each of the channels of the array.

33. Apparatus as claimed in claim 32, wherein each module is formed with means for supplying ink comprising a duct element into which the channels of the module open, the duct element of the modules forming a continuous duct when the modules are butted to form the body of the printhead.

34. Apparatus as claimed in claim 33, wherein the channels and the continuous duct are provided with a cover plate.

35. Apparatus as claimed in claim 32, wherein the channels of said modules are provided with a cover plate extending throughout the array of channels and in which are formed said ink supply duct means.

36. Apparatus as claimed in claim 21, wherein each channel has a length and communicates at opposite ends of the channel with ducts for supply of printing liquid and at a midpoint of the length of the channel with a respective nozzle.

37. Apparatus as claimed in claim 36, wherein said nozzle of each of said channels is formed in said cover.

38. The apparatus claimed in claim 21, wherein each said facing end surface forms a half-width channel which forms a channel when butted against a like half-width channel formed in a facing end surface.

39. A method of manufacturing a drop-on-demand droplet printing apparatus comprising a body formed with a high density array of parallel printing liquid channels extending normal to an array direction, nozzles respectively connected with said channels, means for supplying printing liquid with which said channels each communicate and means for applying pressure pulses provided with each of said channels and adapted to apply said pressure pulses to the printing liquid in respective said channels to effect droplet ejection therefrom, the method comprising the steps of forming said body from a plurality of like modules with each said module having opposite end surfaces disposed normal to said array direction and a center disposed between said end surfaces, said modules being serially butted together with respective end surfaces thereof facing each other, applying a single nozzle plate to said body to span said modules and butted joins between said modules, and so forming in said nozzle plate respective nozzles for channels of the array, a separation of nozzles opposite said butted joins being greater than a separation of nozzles opposite said modules, the nozzles having axes progressively increasingly inclined from the nozzles at the center of each module to the nozzles at the opposite ends of a module such that droplets ejected from said nozzles are deposited on a printing surface at a substantially uniform spacing transversely to a direction of relative movement between the apparatus and said surface.

40. The method claimed in claim 39, comprising the step of forming said nozzles with the axes of at least alternate nozzles coplanar and so included so that in operation of the apparatus droplets are deposited from the nozzles on a printing surface at a substantially uniform spacing transversely in the direction of relative movement between the apparatus and said surface.

41. The method claimed in claim 39, comprising the step of forming said nozzles with a slightly convergent, high energy beam directed towards the nozzle plate and by way of a mask formed with apertures corresponding to the nozzles to be formed.

42. The method claimed in claim 39, with said channels having respective axes lying in a common plane comprising the step of forming said body from said modules with at least a number of said nozzles of each of said modules adjacent each of said butted surfaces thereof outwardly fanned in said common plane to enable deposition of droplets from the channels corresponding to said outwardly fanned nozzles to be deposited on said printing surface at uniform spacing.

43. The method claimed in claim 39, comprising the step of forming said nozzles in said nozzle plate by laser ablation using a convergent excimer laser beam thereby to form nozzles having axes progressively increasingly inclined from the nozzles at the center of each module to the nozzles at opposite ends in the array direction of said module.

44. A drop-on-demand droplet printing apparatus comprising a body formed with a high density array of parallel printing liquid channels extending normal to an array direction, nozzles respectively connected with said channels and means for applying pressure pulses provided with each channel and adapted to apply said pressure pulses to the printing liquid in an associated channel to effect droplet ejection therefrom, wherein said body comprises a plurality of like modules with each said module having opposite end surfaces disposed normal to said array direction and a center disposed therebetween, said modules being serially butted together with respective end surfaces thereof facing each other, and a spacing between channels in each module being a constant channel separation and the spacing between adjacent channels one each from respective butted modules being greater than said channel separation, and said nozzles having axes progressively increasingly inclined from the nozzles at the center of each module to the nozzles at opposite ends of each module so as to enable ejection of droplets to be deposited on a printing surface at a substantially uniform spacing transversely to a direction of relative movement between the apparatus and said surface.

45. The apparatus as claimed in claim 44, wherein said nozzles are formed in a single nozzle plate which spans the channels of the serially butted modules.

46. A drop-on-demand printing apparatus comprising a body formed with a high density array, extending in an array direction, of parallel printing liquid channels extending normal to said array direction, nozzles respectively connected with said channels and means for applying pressure pulses provided with each channel and adapted to apply said pressure pulses to the printing liquid in an associated channel to effect droplet ejection therefrom, wherein said body comprises a plurality of like modules with each said module having opposite end surfaces disposed normal to said array direction and a center disposed therebetween, said modules being serially butted together with respective end surfaces thereof facing each other and said nozzles are so inclined as to enable ejection of droplets to be deposited on a printing surface at a substantially uniform spacing transversely to the direction of relative movement between the apparatus and said surface wherein said nozzles are disposed in a common nozzle plate spanning said modules and have axes progressively increasingly inclined from the nozzles at the center of each module to the nozzles at the opposite ends in the array direction of each said module.

47. A drop-on-demand droplet printing apparatus comprising a body formed with a high density array, extending in an array direction, of parallel, uniformly spaced, printing liquid channels extending normal to said array direction and having channel side walls in said body separated by channel base walls in said body, nozzles respectively connected with said channels and means for effecting displacement of said channel side walls to apply pressure pulses to printing liquid in selected channels to effect droplet ejection therefrom, wherein said body comprises a plurality of like modules with each said module having respective end surfaces disposed normal to said array direction, said modules being serially butted together with respective end surfaces thereof facing each other to form a pair of butted modules, with each of said modules being formed in each of said facing end surfaces with a channel side wall and part of a channel base wall so that further channels are formed between respective pairs of said butted modules thereby affording in said body an array of like channels uniformly spaced in said array direction and said nozzles having respective parallel axes to enable ejection of droplets to be deposited on a printing surface at a predetermined spacing transversely to a direction of relative movement between the apparatus and said surface.

48. Apparatus according to claim 47, wherein said channel side walls comprise piezo-electric material and wherein electrodes are provided for the generation of electric fields in said side walls for effecting deflection in shear mode of said channel side walls.

49. Apparatus as claimed in claim 47, wherein said body is formed from a plurality of like modules having channels, each channel having a length and communicating at opposite ends of the channel with ducts for supply of printing liquid and at a midpoint of the length of the channel with a respective nozzle.

50. Apparatus as claimed in claim 49, wherein said nozzle of each of said channels is formed in said cover.

51. A drop-on-demand printing apparatus comprising a body formed with a high density array of parallel printing liquid channels extending normal to an array direction, each said channel having a length, a base, and ends and said channels defining channel-dividing side walls between said channels;

said side walls being transversely displaceable thereby to effect droplet ejection from a nozzle disposed intermediate the ends of each channel;

each said channel communicating with ducts for supplying printing liquid to respective portions of each channel on opposite sides of said nozzle.

52. Apparatus according to claim 51, wherein said side walls are displaceable in response to electrical actuation pulses.

53. Apparatus according to claim 52, wherein said walls comprise piezoelectric material.

54. Apparatus according to claim 53, wherein said piezoelectric material deforms in shear mode under the effect of said electrical actuation pulses.

55. Apparatus according to claim 54, wherein said piezoelectric material is polarized in a direction normal to the length of each channel and to said array direction.

56. Apparatus according to claim 51, wherein said body is formed with an array of open topped channels closed by a cover, said nozzle of each said channel being formed in said cover.

57. Apparatus according to claim 51, wherein said array of channels and said ducts are formed in a sheet.

58. Apparatus according to claim 57, wherein said ducts communicate with the base of each said channel.

59. Apparatus according to claim 51, wherein-said nozzle is disposed at a midpoint of the length of [said] each channel.

60. Apparatus according to claim 51, wherein each said channel communicates at opposite ends thereof with said ducts.

61. A method of drop-on-demand printing using a printhead having an array of channels defined by side walls and each of said channels having a length, comprising the steps of:

providing a nozzle disposed intermediate the length of said channels;

filling said channels with printing liquid; and displacing a wall of at least one of said channels to develop pressure along the length of the at least one of said channels which generates flows of said printing liquid in opposite directions towards said nozzle, thereby to eject a droplet of said printing liquid through said nozzle.

62. A method of drop-on-demand printing using a printhead having an array of channels defined by side walls and each having a length, said channels being filled with printing liquid, comprising the steps of:

providing a nozzle intermediate the length of said channels;

providing supply ducts within said channels on opposite sides of the nozzle;

displacing a wall of at least one of said channels to eject a droplet of printing liquid through said nozzle; and replenishing the at least one of said channels by further introducing said printing liquid into the channels from said supply ducts.

* * * * *

UNITED STATES PATENT AND TRADEMARK OFFICE

CERTIFICATE OF CORRECTION

PATENT NO. : 5,959,643

DATED : September 28,1999

INVENTOR(S) : Stephen Temple and Richard Shepherd

It is certified that error appears in the above-identified patent and that said Letters Patent is hereby corrected as shown below:

On the title page of the patent, the asterisk "*" preceding the issue date should be deleted.

On the title page of the patent, the following notice referenced by the asterisk should be deleted:

[*] Notice: This patent issued on a continued prosecution application filed under 37 CFR 1.53(d), and is subject to the twenty year patent term provisions of 35 U.S.C. 154(a)(2).

Signed and Sealed this

Second Day of May, 2000

*Attest:*

Q. TODD DICKINSON

*Attesting Officer*

*Director of Patents and Trademarks*